US010507995B2

(12) United States Patent
Hirata et al.

(10) Patent No.: US 10,507,995 B2
(45) Date of Patent: Dec. 17, 2019

(54) SHEET CONVEYING DEVICE, IMAGE READING DEVICE, AND IMAGE FORMING APPARATUS

(71) Applicants: Munekazu Hirata, Kanagawa (JP); Satoshi Narai, Kanagawa (JP); Yasunobu Youda, Kanagawa (JP); Tatsuaki Nagano, Kanagawa (JP); Takayuki Andoh, Kanagawa (JP); Daisuke Imaki, Tokyo (JP); Tomoya Fujii, Kanagawa (JP); Toshiyuki Horikawa, Kanagawa (JP); Koji Hatayama, Kanagawa (JP); Kaoru Tada, Kanagawa (JP); Naoto Kitamura, Kanagawa (JP)

(72) Inventors: Munekazu Hirata, Kanagawa (JP); Satoshi Narai, Kanagawa (JP); Yasunobu Youda, Kanagawa (JP); Tatsuaki Nagano, Kanagawa (JP); Takayuki Andoh, Kanagawa (JP); Daisuke Imaki, Tokyo (JP); Tomoya Fujii, Kanagawa (JP); Toshiyuki Horikawa, Kanagawa (JP); Koji Hatayama, Kanagawa (JP); Kaoru Tada, Kanagawa (JP); Naoto Kitamura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/100,376

(22) Filed: Aug. 10, 2018

(65) Prior Publication Data

US 2019/0047809 A1 Feb. 14, 2019

(30) Foreign Application Priority Data

Aug. 10, 2017 (JP) ..... 2017-156147

(51) Int. Cl.
*B65H 3/52* (2006.01)
*B65H 3/06* (2006.01)

(52) U.S. Cl.
CPC ..... *B65H 3/5223* (2013.01); *B65H 3/06* (2013.01); *B65H 2402/10* (2013.01);
(Continued)

(58) Field of Classification Search
CPC ..... B65H 3/5223; B65H 2402/10; B65H 2402/31; B65H 2402/543; B65H 2601/324
See application file for complete search history.

(56) References Cited

U.S. PATENT DOCUMENTS 9,708,142 B2 * 7/2017 Ohta ..... B65H 3/5215
10,011,445 B2 * 7/2018 Suto ..... B65H 1/04
(Continued)

FOREIGN PATENT DOCUMENTS

JP 2005-060090 3/2005
JP 2006-264864 10/2006
(Continued)

OTHER PUBLICATIONS

Extended Search Report for corresponding European Application No. 18187343.1 dated Mar. 6, 2019.

*Primary Examiner* — Patrick Cicchino
(74) *Attorney, Agent, or Firm* — Harness, Dickey & Pierce, P.L.C.

(57) ABSTRACT

A sheet conveying device includes a separator to separate a sheet from sheets. The separator includes a separation conveyor; a separation resistance member to press against the separation conveyor via the sheet; a resistance-member holder; a biasing member to contact and bias the resistance-member holder to press the separation resistance member toward the separation conveyor, the resistance-member
(Continued)

holder to rotate about a resistance-member rotary shaft to separate from the biasing member in detaching from an apparatus body; and a biasing-member holder configured to rotate about a biasing-member rotary shaft to more incline the biasing member in a state, in which the biasing member is spaced apart from the resistance-member holder, in a moving direction of the resistance-member holder to detach from the apparatus body than the biasing member in a biasing state in which the biasing member biases the resistance-member holder in contact with the resistance-member holder.

20 Claims, 7 Drawing Sheets

(52) U.S. Cl.
CPC .... *B65H 2402/31* (2013.01); *B65H 2402/543* (2013.01); *B65H 2601/324* (2013.01); *B65H 2801/06* (2013.01); *B65H 2801/39* (2013.01)

(56) References Cited

U.S. PATENT DOCUMENTS

| | | | | |
|---|---|---|---|---|
| 2014/0252713 | A1 | 9/2014 | Masubuchi et al. | |
| 2014/0353904 | A1 | 12/2014 | Tahara et al. | |
| 2015/0001787 | A1* | 1/2015 | Tahara ..... | B65H 3/0684 271/117 |
| 2015/0251864 | A1 | 9/2015 | Aoyama et al. | |
| 2016/0368728 | A1 | 12/2016 | Hirata et al. | |
| 2017/0115616 | A1 | 4/2017 | Suto et al. | |
| 2017/0136784 | A1* | 5/2017 | Ueno ..... | B65H 3/02 |

FOREIGN PATENT DOCUMENTS

| | | |
|---|---|---|
| JP | 2010-100366 | 5/2010 |
| JP | 2012-240761 | 12/2012 |
| WO | WO2013/161534 A1 | 10/2013 |

* cited by examiner

SHEET CONVEYING DEVICE, IMAGE READING DEVICE, AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2017-156147, filed on Aug. 10, 2017, in the Japan Patent Office, the entire disclosure of which is incorporated by reference herein.

BACKGROUND

Technical Field

Aspects of the present disclosure relate to a sheet conveying device, an image reading device, and an image forming apparatus.

Related Art

Conventionally, a sheet conveying device has been known that includes a separator including a separation conveyor to convey a sheet and a separation resistance member brought into pressure contact with the separation conveyor while sandwiching a sheet, as a separator to separate one sheet from a plurality of sheets. The separation resistance member contacts the conveyed sheet either in a stopped state or in a state of moving in a direction opposite to a conveyance direction, and hinders the movement of the sheet in the conveyance direction by a frictional force against the sheet. As such a type of sheet conveying device, a device has been known that includes a separator including a resistance-member holder holding a separation resistance member and a biasing member to bias the resistance-member holder such that the separation resistance member is pressed toward the separation conveyor.

SUMMARY

In an aspect of the present disclosure, there is provided a sheet conveying device that includes a separator to separate a sheet from a plurality of sheets. The separator includes a separation conveyor, a separation resistance member, a resistance-member rotary shaft, a resistance-member holder, a biasing member, a biasing-member rotary shaft, and a biasing-member holder. The separation conveyor conveys the sheet. The separation resistance member presses against the separation conveyor via the sheet. The resistance-member holder is rotatable about the resistance-member rotary shaft with respect to an apparatus body and holds the separation resistance member. The biasing member contacts and biases the resistance-member holder to press the separation resistance member toward the separation conveyor. The resistance-member holder is configured to rotate about the resistance-member rotary shaft to separate from the biasing member in detaching from the apparatus body. The biasing-member holder is rotatable about the biasing-member rotary shaft and holds the biasing member. The biasing-member holder is configured to rotate to more incline the biasing member in a state, in which the biasing member is spaced apart from the resistance-member holder, in a moving direction of the resistance-member holder that moves to detach from the apparatus body than the biasing member in a biasing state in which the biasing member biases the resistance-member holder in contact with the resistance-member holder.

In another aspect of the present disclosure, there is provided a sheet conveying device that includes a separator to separate a sheet from a plurality of sheets. The separator includes a separation conveyor, a separation resistance member, a resistance-member holder, a biasing member, a biasing-member rotary shaft, and a biasing-member holder. The separation conveyor conveys the sheet. The separation resistance member presses against the separation conveyor via the sheet. The resistance-member holder is rotatable about a resistance-member rotary shaft with respect to an apparatus body and holds the separation resistance member. The biasing member biases the resistance-member holder to press the separation resistance member toward the separation conveyor. The biasing-member holder is rotatable about the biasing-member rotary shaft with respect to the apparatus body and holds the biasing member. The biasing-member rotary shaft is positioned on a virtual straight line parallel to a biasing direction of the biasing member at an attachment position of the biasing member in the biasing-member holder.

In still another aspect of the present disclosure, there is provided a sheet conveying device that includes a separator to separate a sheet from a plurality of sheets. The separator includes a separation conveyor, a separation resistance member, a resistance-member rotary shaft, a resistance-member holder, a biasing member, a biasing-member rotary shaft, and a biasing-member holder. The separation conveyor conveys the sheet. The separation resistance member presses against the separation conveyor via the sheet. The resistance-member holder is rotatable about the resistance-member rotary shaft with respect to an apparatus body and holds the separation resistance member. The biasing member biases the resistance-member holder to press the separation resistance member toward the separation conveyor. The biasing-member holder is rotatable about the biasing-member rotary shaft with respect to the apparatus body and holds the biasing member. When a rotation position of the biasing-member holder in a state in which the resistance-member holder is detached from the apparatus body is a first rotation position and a rotation position of the biasing-member holder in a state in which the resistance-member holder is assembled to the apparatus body is a second rotation position, the biasing member held by the biasing-member holder at the first rotation position is positioned at a more downstream side in a moving direction of the resistance-member holder that moves to detach from the apparatus body than the biasing member held by the biasing-member holder at the second rotation position.

In still yet another aspect of the present disclosure, there is provided an image reading device that includes the sheet conveying device according to any one of the above-described aspects and an image reader. The image reader to read an image on a surface of the sheet conveyed by the sheet conveying device.

In still yet another aspect of the present disclosure, there is provided an image forming apparatus that includes the image reading device and an image formation unit to form an image based on a read image read by the image reading device.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
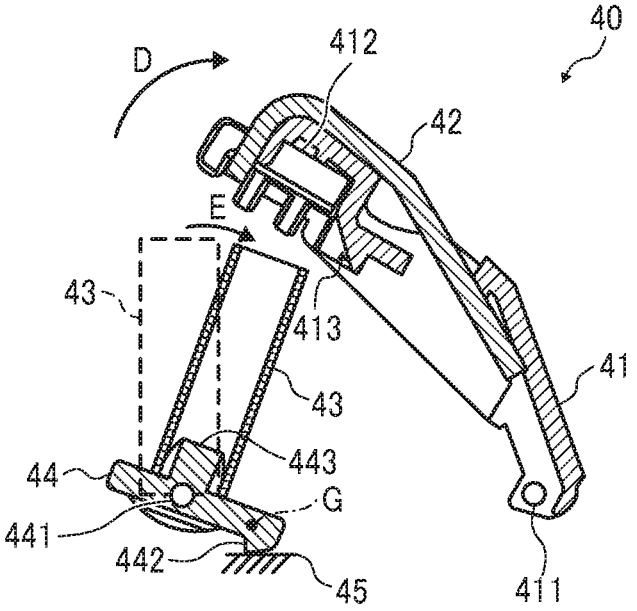
FIG. 1 is a cross-sectional view of a document separation mechanism rotated in a direction of detaching a separation pad holder.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
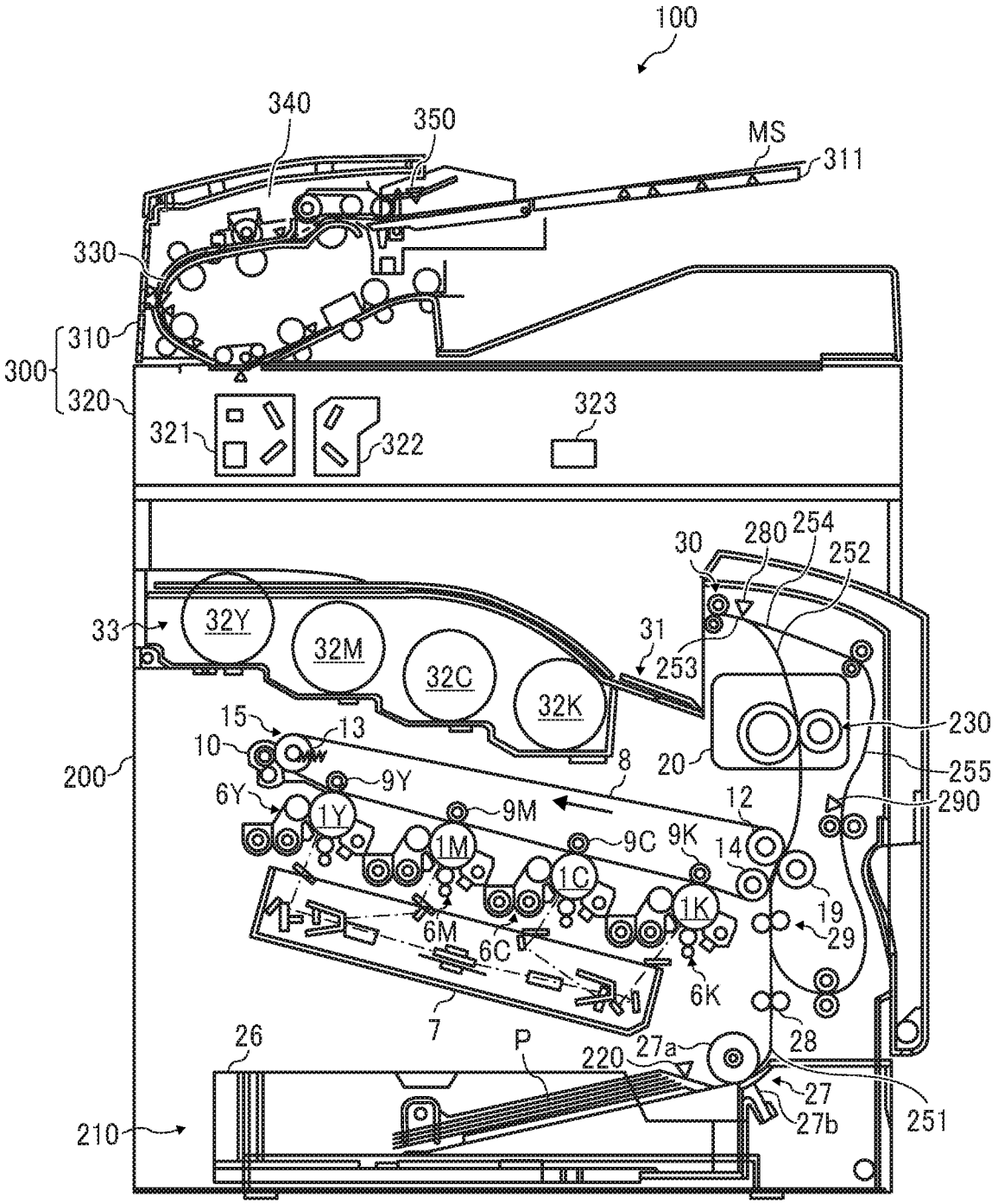
FIG. 2 is a schematic configuration diagram of a copier according to an embodiment of the present disclosure.

Hereinafter, embodiments of the present disclosure will be described with reference to the drawings. FIG. 2 is a schematic configuration diagram illustrating a copier 100 as an example of an image forming apparatus including a sheet conveying device according to an embodiment of the present disclosure. The copier 100 is an electrophotographic image forming apparatus and includes a printer 200 as an image formation unit and an image reading device 300. Although the configuration of including the electrophotographic printer 200 is described in the present embodiment, an image forming system of an image forming apparatus such as the copier 100 may be another system such as an ink jet system.

The printer 200 forms a toner image on paper (recording sheet) P, which is a sheet serving as a recording medium supplied from a sheet feeding device 210 serving as a sheet supplier, based on image data of an image read by the image reading device 300 and image data sent from an external device.

The image reading device 300 includes an auto document feeder (ADF) 310 serving as the sheet conveying device and a scanner 320. The auto document feeder 310 feeds a document MS, which is a sheet serving as an image reading target set by a user, and the scanner 320 reads an image of the document MS fed from the auto document feeder 310.

A thickness of a sheet such as the paper P and the document MS as an object to be conveyed is, for example, 50 μm to 500 μm. A sheet such as the paper P and the document MS, which is generally called high-quality paper and has a thickness of about 100 μm (for example, 100 μm±10 μm) is used as the object to be conveyed.

The printer 200 includes four image formation units 6 (Y, M, C, and K) to form toner images of yellow, magenta, cyan, and black (hereinafter referred to as Y, M, C, and K), respectively. The image formation units 6 have the same configuration except for using Y, M, C, and K toners of different colors as image-forming substances and are replaced when the life expires. Each of the image formation units 6 (Y, M, C, and K) includes drum-shaped photoconductors 1 (Y, M, C, and K) serving as latent image bearers, a drum cleaning device serving as a photoconductor cleaner, a charge-removing device, a charging device, a developing device, and the like. The image formation units 6 can be attached to and detached from the printer 200, and are configured such that expendable parts can be replaced at once.

In FIG. 2, an optical writing unit 7 is disposed below the image formation units 6 (Y, M, C, and K). The optical writing unit 7 serving as a latent image formation unit irradiates the respective photoconductors 1 (Y, M, C, and K) in the image formation units 6 (Y, M, C, and K) with laser light L emitted based on image information to perform exposure. With the exposure, electrostatic latent images for Y, M, C, and K are formed on surfaces of the respective photoconductors 1 (Y, M, C, and K). The optical writing unit 7 irradiates the photoconductor with laser light emitted from a light source via a plurality of optical lenses and mirrors while deflecting the laser light in a main-scanning direction (a photoconductor axis direction) using a polygon mirror driven to rotate by a motor.

The sheet feeding device 210 serving as a sheet feeding device, which includes a sheet containing cassette 26 and a sheet feeding separation mechanism 27 incorporated in the sheet containing cassette 26, is disposed below the optical writing unit 7. The sheet containing cassette 26 stores the paper P in a state in which a plurality of sheets is stacked in a sheet bundle. In addition, the sheet feeding separation mechanism 27 forms a sheet feeding separation nip by a sheet feeding roller 27*a* capable of being driven to rotate and a sheet feeding separation pad 27*b* contacting the sheet feeding roller 27*a*.

The sheet feeding roller 27*a* of the sheet feeding separation mechanism 27 is in contact with the uppermost paper P in the sheet bundle inside the sheet containing cassette 26. The sheet feeding roller 27*a* is driven to rotate to feed the paper P into the sheet feeding separation nip. When a plurality of sheets of paper P is fed into the sheet feeding separation nip in a stacked state, the sheet feeding roller 27*a* contacts merely the uppermost paper P among the sheets. The uppermost paper P moves in a sheet feeding direction inside the sheet feeding separation nip following surface movement of the sheet feeding roller 27*a*. On the other hand, a load resistance generated by the sheet feeding separation pad 27*b* whose surface does not move is imparted to paper P on the lower side excluding the uppermost paper P. As a result, the lower-side paper P is hardly moved in the sheet feeding direction following the uppermost paper P and remains in the sheet feeding separation nip. In this manner, the sheet feeding separation mechanism 27 separates merely one sheet of the uppermost paper P out of the plurality of sheets of paper P fed from the inside of the sheet containing cassette 26 to be fed from the sheet feeding separation nip toward a sheet feeding path 251 which is a first sheet conveyance path.

A pair of conveying rollers 28 as conveyors is disposed in the vicinity of an intermediate point in a length direction of the sheet feeding path 251. The pair of conveying rollers 28 is configured such that two rollers contact each other to form a conveyance nip, and one of the rollers is driven to rotate by a driver.

Further, a pair of registration rollers 29 as abutment conveyors is disposed in the vicinity of a terminal in the length direction of the sheet feeding path 251. The pair of registration rollers 29 is configured such that two registration rollers contact each other to form a registration nip serving as an abutment conveyance nip. One registration roller out of the two registration rollers is driven to rotate by a driver.

A conveyance driving roller, which is the roller driven to rotate out of the pair of conveying rollers 28, starts to be driven to rotate at substantially the same time as or with a slight time lag from the start of the rotational drive of the sheet feeding roller 27*a* of the sheet feeding separation mechanism 27. A leading end portion of the paper P fed from the sheet feeding separation nip of the sheet feeding separation mechanism 27 to the sheet feeding path 251 is soon nipped by the conveyance nip of the pair of conveying rollers 28. The conveyance driving roller is driven to rotate at a higher linear velocity than the sheet feeding roller 27*a*, and thus, the paper P is stretched with a strong tension between the sheet feeding separation nip and the conveyance nip at this time. As a strong torque is applied to the sheet feeding roller 27*a*, a torque limiter operates so that the sheet feeding roller 27*a* rotates along with the paper P.

Then, the paper P is fed from the inside of the conveyance nip toward the pair of registration rollers 29 by the rotational drive of the conveyance driving roller, and then, a leading end of the paper P abuts the registration nip of the pair of registration rollers 29. At this time, the rotational drive of the pair of registration rollers 29 is stopped, and thus, the paper P hardly enters the registration nip and gradually deflects. With such deflection, a skew of the paper P is corrected.

The rotation drive of the sheet feeding roller 27*a* of the sheet feeding separation mechanism 27 and the rotational drive of the pair of conveying rollers 28 are stopped when a predetermined timing comes after the paper P starts to be fed from the conveyance nip of the pair of conveying rollers 28. As a result, the conveyance of the paper P is temporarily stopped in a state in which the leading end portion is deflected.

Above the image formation units 6 (Y, M, C, and K) in FIG. 2, an intermediate transfer unit 15 to endlessly move an intermediate transfer belt 8 serving as an intermediate transferer while stretching the intermediate transfer belt 8. The intermediate transfer unit 15 includes not only the intermediate transfer belt 8 but also four primary transfer bias rollers 9 (Y, M, C, and K), a belt cleaning device 10, and the like. Further, the intermediate transfer unit 15 also includes a secondary transfer backup roller 12, a cleaning backup roller 13, a tension roller 14, and the like.

The intermediate transfer belt 8 is endlessly moved counterclockwise of FIG. 2 by rotational drive of at least one roller while being stretched by three rollers inside a loop. Each of the primary transfer bias rollers 9 (Y, M, C, and K) forms a primary transfer nip by nipping the intermediate transfer belt 8 endlessly moved as above with the photoconductor (Y, M, C, and K). The primary transfer bias rollers 9 are of a system that applies a transfer bias of a polarity (for example, positive) opposite to a polarity of a toner to a back surface (loop inner peripheral surface) of the intermediate transfer belt 8. All the rollers excluding the primary transfer bias rollers 9 (Y, M, C, and K) are electrically grounded. While the intermediate transfer belt 8 sequentially passes through the primary transfer nips for Y, M, C, and K along with the endless movement, the Y, M, C, and K toner images on the photoconductors 1 (Y, M, C, and K) are superimposed and primarily transferred onto the intermediate transfer belt 8. As a result, a four-color superimposed toner image (hereinafter referred to as a four-color toner image) is formed on the intermediate transfer belt 8.

The secondary transfer backup roller 12 disposed at the inner side of a belt loop forms a secondary transfer nip by nipping the intermediate transfer belt 8 with the secondary transfer roller 19 disposed at the outer side of the belt loop. The four-color toner image on the intermediate transfer belt 8 is transferred onto the paper P at the secondary transfer nip. A transfer residual toner that has not been transferred to the paper P adheres to the intermediate transfer belt 8 after having passed through the secondary transfer nip. The transfer residual toner is cleaned by the belt cleaning device 10.

When the rotational drive of the sheet feeding roller 27*a* and the pair of conveying rollers 28 is temporarily stopped, and then, a timing at which the paper P can be synchronized with the four-color toner image on the intermediate transfer belt 8 inside the secondary transfer nip comes, the rotational drive of the sheet feeding roller 27*a* and the pair of conveying rollers 28 is resumed. Further, the rotational drive of the pair of registration rollers 29 is started. As a result, the paper P is nipped by the registration nip of the pair of registration rollers 29, and then, fed from the registration nip toward the secondary transfer nip. Then, the paper P is superimposed on the four-color toner image on the intermediate transfer belt 8 at the secondary transfer nip.

A fixing device 20 is disposed above the secondary transfer nip, the four-color toner image having transferred to the surface of the paper P fed from the secondary transfer nip is fixed by heat and pressure when the paper P passes between the fixing roller pair 230 of the fixing device 20. Then, the paper P passes between rollers of a sheet ejection roller pair 30 and is discharged outside of the apparatus. A stacker 31 is formed on an upper surface of the printer 200, and the paper P discharged outside the apparatus by the sheet ejection roller pair 30 is sequentially stacked on the stacker 31.

Between the intermediate transfer unit 15 and the stacker 31 above the intermediate transfer unit 15, a bottle container 33 is disposed. The bottle container 33 contains tonner bottles 32 (Y, M, C, and K) as replenishment toner storages containing the Y, M, C, and K toners. The toner bottles 32 (Y, M, C, and K) are installed on the bottle container 33 to be placed from above for each toner color. The Y, M, C, and K toners in the toner bottles 32 (Y, M, C, and K) are appropriately supplied to the developing devices of the image formation units 6 (Y, M, C, and K), respectively, by a toner supply device serving as a toner conveyor. The toner bottles 32 (Y, M, C, and K) can be detached from the printer 200 independently of the image formation units 6 (Y, M, C, and K).

In the vicinity of the fixing device 20, a switchback device is disposed. In a duplex print mode of forming images on both sides of the paper P, the paper P having passed through the fixing device 20 after a toner image is formed on one side is vertically reversed by the switchback device. The vertically-reversed paper P is fed again toward the registration nip of the pair of registration rollers 29 passing through a fourth sheet conveyance path 254 and a reversal path 255. Then, the paper P is fed from the registration nip to the secondary transfer nip, a toner image is also formed on the other side, the toner image on the other side is subjected to fixing treatment by the fixing device 20, and then, the paper P passes through the sheet ejection roller pair 30 to be stacked on the stacker 31.

As illustrated in FIG. 2, the image reading device 300 including the auto document feeder 310 and the scanner 320 is disposed above the printer 200. The image reading device 300 is secured onto a stand supported by two legs secured to the back side of the printer 200, and there is a large space between the stacker 31 of the printer 200 and the stand. The paper P stacked on the stacker 31 is positioned in the space.

The scanner 320 of the image reading device 300 includes a stationary reader 321 and a movable reader 322. The movable reader 322 is disposed immediately below a second contact glass secured to an upper wall of a casing of the scanner 320 so as to contact the document MS and can move an optical system including a light source, reflection mirrors, and the like in a lateral direction of FIG. 2. In the course of moving the optical system from the left side to the right side of FIG. 2, light emitted from the light source is reflected by a surface of the document placed on the second contact glass, and then, the reflected light passes through the plurality of reflecting mirrors and is received by an image reading sensor 323 secured to a scanner body.

On the other hand, the stationary reader 321 includes a light source, reflection mirrors, an image reading sensor such as a charge-coupled device (CCD), and is disposed immediately below a first contact glass secured to the upper wall of the casing of the scanner 320 so as to contact the document MS. When the document MS conveyed by the auto document feeder 310 passes over the first contact glass, light emitted from the light source is caused to pass through the plurality of reflection mirrors to be received by the image reading sensor while being sequentially reflected by the document surface. As a result, a first surface of the document MS is optically scanned without moving the optical system including the light source, the reflection mirrors, and the like. The auto document feeder 310 includes a second surface stationary reader to optically scan a second surface of the document MS.

When a document bundle in which a plurality of documents MS is stacked is set in the auto document feeder 310, the documents MS can be automatically fed one by one. The image of the document MS automatically fed one by one can be sequentially read by the stationary reader 321 inside the scanner 320 or the second surface stationary reader inside the auto document feeder 310. In this case, the document bundle is set on the document placing base 311, and then, a copy start button is pressed. Then, the auto document feeder 310 conveys the documents MS of the document bundle placed on the document placing base 311 sequentially from the top. In the course of such conveyance, the document MS is caused to pass right above the stationary reader 321 of the scanner 320 immediately after reversing the document MS. At this time, the image on the first surface of the document MS is read by the stationary reader 321 of the scanner 320.

The printer 200 of the copier 100 having the above configuration has first to fifth sheet conveyance paths (reference numerals 251 to 255) as sheet conveyance paths to convey the paper P.

In the sheet feeding path 251, the paper P supplied one by one from the sheet feeding device 210 is conveyed. The paper P contained in the sheet containing cassette 26 is fed out by the sheet feeding roller 27*a* and is conveyed to the secondary transfer nip at which the secondary transfer backup roller 12 opposes the secondary transfer roller 19 via the pair of conveying rollers 28 and the pair of registration rollers 29. In the secondary transfer nip, the toner image on the intermediate transfer belt 8 is transferred onto the paper P. Whether the paper P is present on the sheet containing cassette 26, which contains the paper P to be conveyed in the sheet feeding path 251 is detected by a cassette paper sensor 220 serving as a sheet detection device.

In the second sheet conveyance path 252, the paper P to which the toner image has been transferred in the secondary transfer nip passes through the nip portion of the fixing roller pair 230 of the fixing device 20, and then, is conveyed toward the sheet ejection roller pair 30.

In the third sheet conveyance path 253, the paper P after fixing is conveyed so as to be discharged onto the stacker 31 via the sheet ejection roller pair 30 during a one-side image forming operation. Further, in the third sheet conveyance path 253, the paper P with a front side on which the toner image has been formed at an image formation position is conveyed toward the sheet ejection roller pair 30 during a duplex image forming operation. Then, the sheet ejection roller pair 30 rotates in a reverse direction at a predetermined timing when a trailing end of the paper P approaches the sheet ejection roller pair 30 so that the paper P is conveyed toward the fourth sheet conveyance path 254. The trailing end of the paper P in the third sheet conveyance path 253 is detected by an outlet sheet sensor 280 serving as a sheet detection device.

In the fourth sheet conveyance path 254, the paper P that has been conveyed from the third sheet conveyance path 253 is further conveyed toward the reversal path 255, which is the fifth sheet conveyance path in order to form an image on the back side of the paper P during the duplex image forming operation.

In the reversal path 255, the paper P that has been conveyed from the fourth sheet conveyance path 254 is conveyed to the secondary transfer nip at which the secondary transfer backup roller 12 opposes the secondary transfer roller 19 via the pair of registration rollers 29. In the secondary transfer nip, the toner image on the intermediate transfer belt 8 is transferred onto the back side of the paper P. The paper P in the reversal path 255 is detected by a reversed-sheet sensor 290 serving as a sheet detection device.

The image reading device 300 has a document conveyance path 330 serving as a sheet conveyance path to convey the document MS. The document conveyance path 330 is formed by a conveyance guide member 340 or the like having a curved guide surface with which the document MS to be conveyed comes into contact. In the document conveyance path 330, the document MS fed by the auto document feeder 310 is conveyed to an image reading position of the stationary reader 321. Whether the document MS is present on the document placing base 311 of the auto document feeder 310 is detected by a document sensor 350 serving as a sheet detection device.

Figure 3:
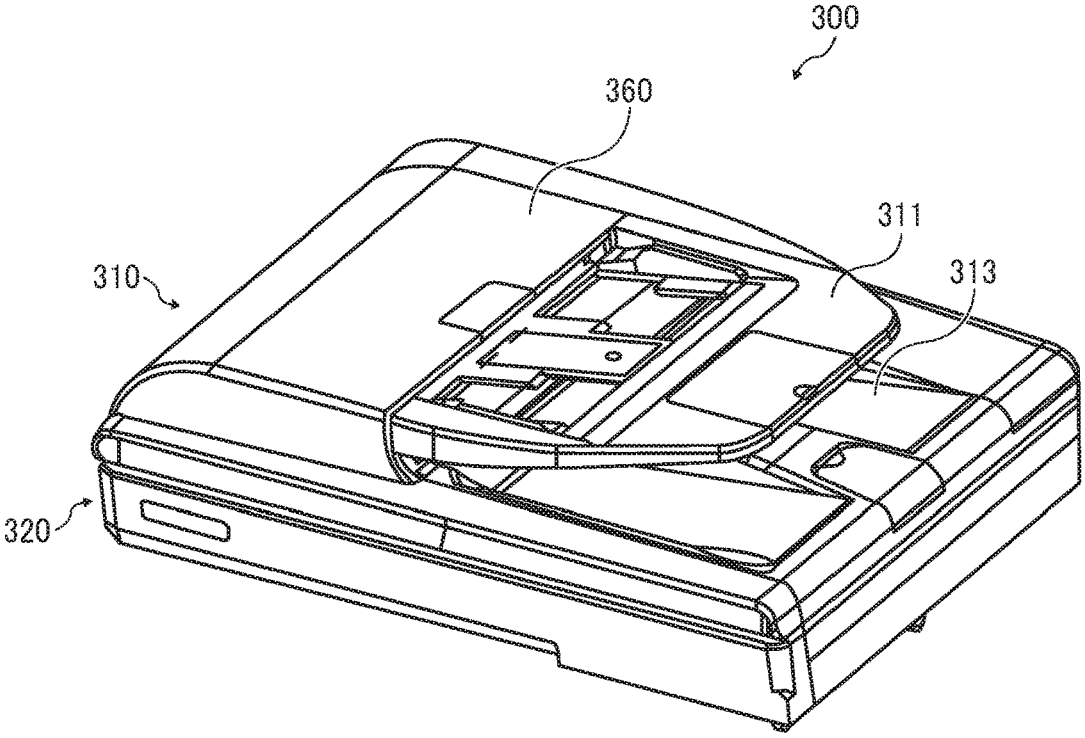
FIG. 3 is a perspective view of an image reading device.
Figure 4:
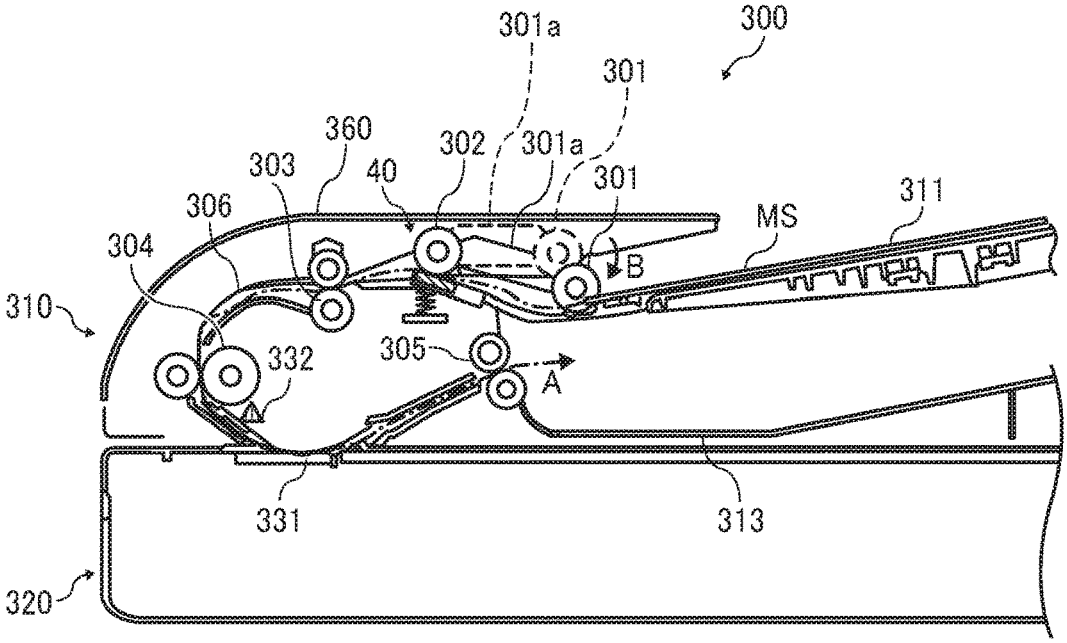
FIG. 4 is a cross-sectional view of the image reading device.

FIG. 3 is a perspective view of the image reading device 300, and FIG. 4 is a cross-sectional view of the image reading device 300. A conveyance path of the document MS inside the apparatus of the auto document feeder 310 is indicated by arrow A in a dashed line in FIG. 4. The auto document feeder 310 includes a pickup roller 301 and a document separation mechanism 40. The pickup roller 301 is a conveying roller to take the document MS set on the document placing base 311 into the apparatus. The document separation mechanism 40 conveys the uppermost sheet out of the document MS taken by the pickup roller 301 toward the document conveyance path 306 by the document feed roller 302, and separates the uppermost sheet of the document MS from the other documents MS when a plurality of documents MS is taken.

When picking up the document MS, the pickup roller 301 moves downward as indicated by arrow B in FIG. 4 from a position indicated by a broken line in FIG. 4, and contacts the uppermost surface of the bundle of documents MS when descending to a position indicated by a solid line. As the pickup roller 301 contacting the document MS is rotated in the clockwise direction of FIG. 4, the document MS in contact with the pickup roller 301 is pulled into the apparatus. When a reading operation of the bundle of documents MS is completed, a standby state is formed in which the pickup roller 301 is moved upward and spaced apart from the document placing base 311 by a predetermined distance. As a result, the user can set the next bundle of documents MS on the document placing base 311.

The pickup roller 301 is rotatably held by a pickup holder 301*a*, and the pickup holder 301*a* is configured to swing up and down via a bi-directional torque limiter provided on a rotary shaft of the document feed roller 302. The pickup holder 301*a* rotates in a direction (a direction of arrow B in FIG. 4) such that an end portion on the side holding the pickup roller 301 descends when a document conveying motor, which is a drive source to drive the pickup roller 301 and the document feed roller 302, rotates forward. When the pickup roller 301 abuts on an upper surface of the document MS, the rotation of the pickup holder 301*a* is stopped by action of the bi-directional torque limiter. On the other hand, when the document conveying motor is reversely rotated, the pickup holder 301*a* rotates in a direction in which the end portion on the side holding the pickup roller 301 ascends (in a direction opposite to the direction of arrow B in FIG. 4). Then, the pickup holder 301*a* abuts on a document feeder cover 360, and the rotation of the pickup holder 301*a* is stopped by the action of the bi-directional torque limiter.

The document MS separated into one sheet by the document separation mechanism 40 is conveyed to a reader 331 by a pair of first document conveying rollers 303 and a pair of second document conveying rollers 304. Then, reading of the document is performed by matching a reading timing of the stationary reader 321 with a leading end of the document MS based on a detection result of a document registration sensor 332. The document MS from which an image has been read by the reader 331 is discharged to a sheet ejection tray 313 by a document sheet ejection roller 305.

Figure 5:
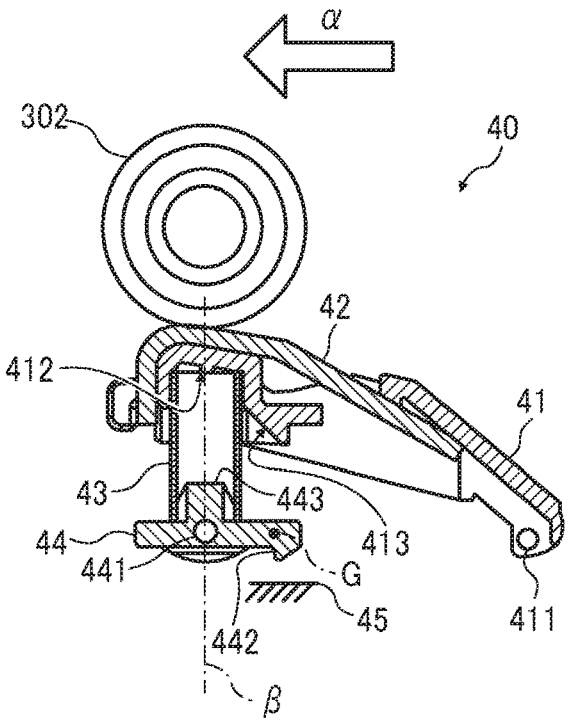
FIG. 5 is an enlarged cross-sectional view of the document separation mechanism in an auto document feeder.

FIG. 5 is an enlarged cross-sectional view of the document separation mechanism 40 in the auto document feeder 310. As illustrated in FIG. 5, the document separation mechanism 40 includes: the document feed roller 302 which is a separation conveyor; a separation pad 42 which is a separation resistance member; a separation pad holder 41 which is a resistance-member holder; a separation-pressing spring 43 which is a biasing member; and a spring holder 44 which is a biasing-member holder.

The document feed roller 302 applies a conveying force toward a document conveyance direction indicated by arrow a in FIG. 5 to the document MS. The separation pad 42 is in pressure contact with the document feed roller 302 while sandwiching the document MS to form a separation nip, and hinders movement of the document MS in the document conveyance direction by a frictional force against the document MS. The separation pad holder 41 holds the separation pad 42 and is rotatable about a first rotary shaft 411 with respect to the apparatus body of the auto document feeder 310. The separation-pressing spring 43 contacts a pressing force acting portion 412 of the separation pad holder 41 such that the separation pad 42 is pressed toward the document feed roller 302 and biases the separation pad holder 41. The spring holder 44 holds the separation-pressing spring 43 and is rotatable about a second rotary shaft 441 with respect to the apparatus body of the auto document feeder 310.

In the document separation mechanism 40, the separation pad 42 is biased by the separation-pressing spring 43 to the document feed roller 302 so that the frictional force against the separation pad 42 is applied to the document MS positioned at the separation nip. When a plurality of documents MS enters the separation nip, the documents MS other than the uppermost sheet are prevented from passing through the separation nip by the frictional force against the separation pad 42. On the other hand, the uppermost document MS is conveyed by the document feed roller 302 and passes through the separation nip. As a result, one document MS among the plurality of documents MS is separated from the other documents MS.

The separation pad holder 41 holding the separation pad 42 is rotatable about the first rotary shaft 411 with respect to the apparatus body in order to swing the separation pad 42 smoothly with respect to the document MS when the document MS is conveyed. The separation-pressing spring 43 is held by the spring holder 44 and biases the pressing force acting portion 412 of the separation pad holder 41.

The separation pad 42 is made of a material such as rubber whose friction coefficient at a contact portion with the document MS is high. Since the separation pad 42 is abraded by rubbing against the document feed roller 302 and the document MS, the life of the separation pad 42 is shorter than the product life of the auto document feeder 310 or the copier 100. Thus, the separation pad 42 is a replaceable part and is configured to be replaced for each of the separation pad holder 41 holding the separation pad 42 in the document separation mechanism 40 of the present embodiment.

When the separation pad holder 41 is detached from the apparatus body in order to replace the separation pad holder 41, the document feeder cover 360 illustrated in FIGS. 3 and 4 is opened and a unit holding the document feed roller 302 is detached. As a result, the document feed roller 302 is moved out of a rotation range of the separation pad holder 41. The separation pad holder 41 is rotated in a rotation direction (clockwise direction in FIG. 5) along a biasing direction (upward in FIG. 5) by the separation-pressing spring 43. The separation pad holder 41 is spaced apart from the separation-pressing spring 43 and rotated to a predetermined rotation position at which the biasing force of the separation-pressing spring 43 does not act. When the separation pad holder 41 is rotated to the predetermined rotation position, it is possible to release engagement between the first rotary shaft 411 of the separation pad holder 41 and an engagement portion on the apparatus body side, and to detach the separation pad holder 41 from the apparatus body.

After detaching the separation pad holder 41 from the apparatus body, it is difficult to apply a desired biasing force to the separation pad holder 41 in a case in which the separation-pressing spring 43 is not in a desired posture illustrated in FIG. 5 when replacing and attaching the separation pad holder 41 to the apparatus body. As a result, a contact pressure of the separation pad 42 with respect to the document feed roller 302 does not become a desired pressure, it is difficult to obtain desired separating performance, and there is a risk that multiple feeding or non-feeding may occur.

FIG. 1 is a cross-sectional explanatory view of the document separation mechanism 40 in a state in which the document feed roller 302 is detached from the state illustrated in FIG. 5 and the separation pad holder 41 is rotated in the clockwise direction in FIG. 5 about the first rotary shaft 411.

The spring holder 44 has a shape of which the right side protrudes more than the left side in FIG. 5 while sandwiching the second rotary shaft 441, and a center of gravity of the spring holder 44 in the state of holding the separation-pressing spring 43 is positioned on the right side in FIG. 5 with respect to the second rotary shaft 441. The spring holder 44 has a contact part 442, which abuts on a rotation regulator 45 on the apparatus body side to regulate rotation when the spring holder 44 rotates in the clockwise direction in FIG. 5, on the right side in FIG. 5 while sandwiching the second rotary shaft 441. The rotation regulator 45 has a planar shape on the apparatus body side.

When the separation pad holder 41 is rotated from the state illustrated in FIG. 5 in the clockwise direction in FIG. 5 (a direction of arrow D in FIG. 1) the separation-pressing spring 43 is spaced apart from the separation pad holder 41 as illustrated in FIG. 1. When the separation-pressing spring 43 is spaced apart from the separation pad holder 41, the spring holder 44 rotates in the clockwise direction in FIGS. 1 and 5 due to own weight of the spring holder 44. At this time, the contact part 442 of the spring holder 44 abuts on the rotation regulator 45 of the apparatus body side, and the rotation of the contact part 442 of the spring holder 44 is regulated and stops in the state illustrated in FIG. 1.

The separation-pressing spring 43 is in a compressed state in the state illustrated in FIG. 5 in order to apply the biasing force to the separation pad holder 41, and thus, is shorter than a natural length. When the separation pad holder 41 is detached, the length of the separation-pressing spring 43 becomes the natural length. At this time, when the spring holder 44 does not rotate but is secured in the state of applying the biasing force to the separation pad holder 41 as illustrated in FIG. 5, the separation-pressing spring 43 having the natural length is at a position indicated by a broken line in FIG. 1. In this state, a leading end of the separation-pressing spring 43 (a portion contacting the separation pad holder 41) is above the leading end in the state illustrated in FIG. 5.

When the separation pad holder 41 is mounted to the apparatus body, the first rotary shaft 411 of the separation pad holder 41 is engaged with the engagement portion on the apparatus body side, and the separation pad holder 41 is rotated about the first rotary shaft 411 in a direction opposite to arrow D in FIG. 1. At this time, as compared with the state in which the separation-pressing spring 43 is at the position indicated by the broken line in FIG. 1, the leading end of the separation-pressing spring 43 is brought into contact with a leading end side (a side far from the first rotary shaft 411) of the pressing force acting portion 412 in the separation pad holder 41. This is because the distance from the first rotary shaft 411 to the leading end of the separation-pressing spring 43 is farther than the distance in the state illustrated in FIG. 5. When the separation pad holder 41 is further rotated to complete mounting directly in the state in which the leading end of the separation-pressing spring 43 is in contact with a portion other than the pressing force acting portion 412, the separation-pressing spring 43 is not set to the desired posture and it is difficult to apply a desired biasing force.

However, in the document separation mechanism 40 of the present embodiment, the separation pad holder 41 is spaced apart from the separation-pressing spring 43 by the rotational movement when the separation pad holder 41 is detached from the apparatus body. The spring holder 44 rotates in the clockwise direction (a direction of arrow E) in FIG. 1 such that the separation-pressing spring 43 spaced apart from the separation pad holder 41 is more inclined in a moving direction of the separation pad holder 41 that moves when the separation pad holder 41 is detached, than the state illustrated in FIG. 5. As a result, the distance from the first rotary shaft 411 to the leading end of the separation-pressing spring 43 in the state of having the natural length can be set to a value which is the same as or close to the distance from the first rotary shaft 411 to the leading end of the separation-pressing spring 43 in the state illustrated in FIG. 5.

Thus, when the separation pad holder 41 is rotated in the direction opposite to arrow D in FIG. 1 about the first rotary shaft 411, the leading end of the separation-pressing spring 43 can be brought into contact with the pressing force acting portion 412 in the separation pad holder 41. When the separation pad holder 41 is further rotated in the direction opposite to arrow D in FIG. 1 in the state in which the separation-pressing spring 43 is in contact with the pressing force acting portion 412, the spring holder 44 rotates in a direction opposite to arrow E in FIG. 1 while the separation-pressing spring 43 pushed by the separation pad holder 41 is compressed. Then, the separation pad holder 41 is rotated to a fixed position to be described later, the unit holding the document feed roller 302 is attached, and the document feeder cover 360 is closed to form the state illustrated in FIG. 5.

As the separation pad holder 41 is mounted in the state in which the separation-pressing spring 43 is in contact with the pressing force acting portion 412, the separation-pressing spring 43 is set to the desired posture illustrated in FIG. 5, and it is possible to apply the desired biasing force to the separation pad holder 41. As a result, the contact pressure of the separation pad 42 with respect to the document feed roller 302 also becomes the desired pressure, and it is possible to obtain desired separation performance and to prevent generation of occurrence of multiple feeding and non-feeding.

In the present embodiment, the second rotary shaft 441, which is the biasing-member rotary shaft, is positioned on a virtual straight line (straight line 3 indicated by a one-dot chain line in FIG. 5) parallel to the biasing direction of the separation-pressing spring 43 at an attachment position of the separation-pressing spring 43 in the spring holder 44. As a result, as a force in a direction orthogonal to the biasing direction is applied to the leading end of the separation-pressing spring 43, the spring holder 44 is easily rotated, and it is easy to match a position of the leading end of the separation-pressing spring 43 in the state of having the natural length with a position of the pressing force acting portion 412 in the separation pad holder 41.

For example, in a comparative configuration in which a biasing-member rotary shaft is positioned on a virtual straight line orthogonal to a biasing direction of a biasing member at an attachment position of the biasing member in a biasing-member holder, there are disadvantages as follows. That is, even when a force in a direction orthogonal to the biasing direction is applied to a leading end of the biasing member, a force toward the biasing-member rotary shaft is applied from the attachment position of the biasing member in the biasing-member holder so that the biasing-member holder hardly rotates. Thus, even when the force in the direction orthogonal to the biasing direction is applied to the leading end of the biasing member, the biasing-member holder does not rotate, and it is difficult to match a position of the leading end of the biasing member in the state of having a natural length with a desired contact position of the biasing member in a resistance-member holder. When mounting is performed in a state in which a contact position with the biasing member in the resistance-member holder deviates from the desired contact position, it is difficult to apply a desired biasing force to the resistance-member holder, and there is a risk that it is difficult to obtain desired separation performance.

In the present embodiment, however, it is easy to match the position of the leading end of the separation-pressing spring 43 with the position of the pressing force acting portion 412 in the separation pad holder 41 as described above, and thus, it is possible to apply the desired biasing force to the separation pad holder 41 and to obtain the desired separation performance.

In the document separation mechanism 40 of the present embodiment, the spring holder 44 has the second rotary shaft 441, and the spring holder 44 also rotates along with the rotational operation at the time of attaching or detaching the separation pad holder 41. Since the spring holder 44 has the second rotary shaft 441, it is possible to make the separation-pressing spring 43 fit to the pressing force acting portion 412 of the separation pad holder 41 when attaching the separation pad holder 41. Thus, the separation-pressing spring 43 can be held in the desired posture, the attachment of the separation pad holder 41 can be made easy, and it is possible to prevent a decrease in separation performance at the time of conveying a document caused by a mounting error and to prevent occurrence of multiple feeding and non-feeding.

As illustrated in FIGS. 1 and 5, a guide-shaped portion 413 to guide the leading end of the separation-pressing spring 43 to the pressing force acting portion 412 is provided on the root side (the first rotary shaft 411 side) of the pressing force acting portion 412 in the separation pad holder 41. As a result, when the separation pad holder 41 is rotated to be attached to the apparatus body, the leading end of the separation-pressing spring 43 in contact with the vicinity of the pressing force acting portion 412 can be guided to the pressing force acting portion 412. Thus, the separation pad holder 41 can be mounted in the state of more reliably holding the separation-pressing spring 43 in the desired posture.

The document separation mechanism 40 of the present embodiment includes the rotation regulator 45 to regulate the rotation of the spring holder 44, and thus, can cause the separation-pressing spring 43 to be brought into contact with and engaged with the pressing force acting portion 412 of the separation pad holder 41. As a result, it is possible to attach the separation pad holder 41 to the apparatus body in the state in which the separation-pressing spring 43 is in the desired posture.

As described with reference to FIG. 1, the spring holder 44 rotates by the own weight when the separation pad holder 41 and the separation-pressing spring 43 are spaced apart from each other. With such a configuration, it is possible to implement the configuration in which the spring holder 44 rotates along with the rotational operation at the time of attaching and detaching the separation pad holder 41 without providing a complex rotation mechanism. Since the spring holder 44 rotates along with the rotational operation at the time of attaching and detaching the separation pad holder 41, the spring holder 44 also rotates merely with the operation of mounting the separation pad holder 41, and it is possible to attach the separation pad holder 41 to the apparatus body in the state in which the separation-pressing spring 43 is in the desired posture.

As illustrated in FIGS. 1 and 5, the spring holder 44 includes a spring fixing boss portion 443 to be inserted inside a coil from a lower end of the separation-pressing spring 43 using a coil spring. The pressing force acting portion 412 is a recess provided on the back side of a surface of the separation pad holder 41 on which the separation pad 42 is disposed, and the separation pad holder 41 and the separation-pressing spring 43 are engaged with each other when an upper end of the separation-pressing spring 43 is inserted into the recess. In the present embodiment, an engagement force between the separation-pressing spring 43 and the spring fixing boss portion 443 is larger than an engagement force between the separation-pressing spring 43 and the pressing force acting portion 412. Thus, when the separation pad holder 41 is rotated in the direction of arrow D in FIG. 1, the engagement between the separation-pressing spring 43 and the pressing force acting portion 412 is released, and the separation-pressing spring 43 is turned into the state of being held by the spring holder 44.

In the document separation mechanism 40 of the present embodiment, the separation-pressing spring 43 is more inclined and is easily engaged with the pressing force acting portion 412 of the separation pad holder 41 in the state illustrated in FIG. 1 than the state illustrated in FIG. 5. Thus, with respect to the rotation position of the spring holder 44 rotating about the second rotary shaft 441, the rotation position illustrated in FIG. 1 is a position at which the separation pad holder 41 can be more easily attached to the apparatus body than the rotation position illustrated in FIG. 5. Such a configuration can facilitate the separation-pressing spring 43 to contact the pressing force acting portion 412, which is a desired contact position in the separation pad holder 41, thus obtaining the stable separation performance after attaching the separation pad holder 41.

Although the present embodiment has the configuration in which a compression spring is used as the biasing member to bias the separation pad holder 41, a member can be used that utilizes elasticity of the member, such as a leaf spring and a resin part, as the biasing member. Since the separation pad holder 41 can be easily assembled with the apparatus body, it is possible to improve maintainability of the auto document feeder 310 which is the sheet conveying device including the separation pad 42. In addition, it is possible to improve each maintainability of the image reading device 300 which is the image reading device including the auto document feeder 310 and the copier 100 which is the image forming apparatus.

Figure 6:
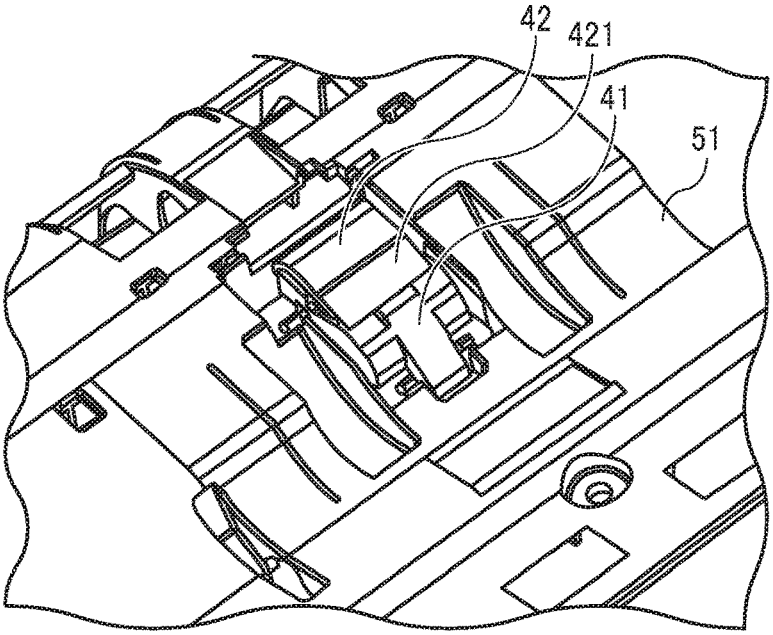
FIG. 6 is an enlarged perspective view of the vicinity of a separation pad of the auto document feeder.
Figure 7:
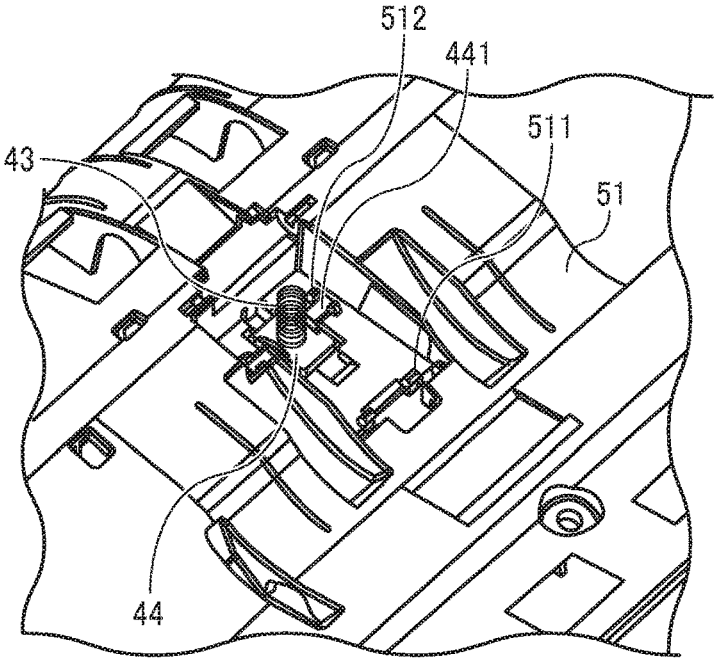
FIG. 7 is an enlarged perspective view of the auto document feeder in a state in which the separation pad holder is detached from the state illustrated in FIG. 6.
Figure 8:
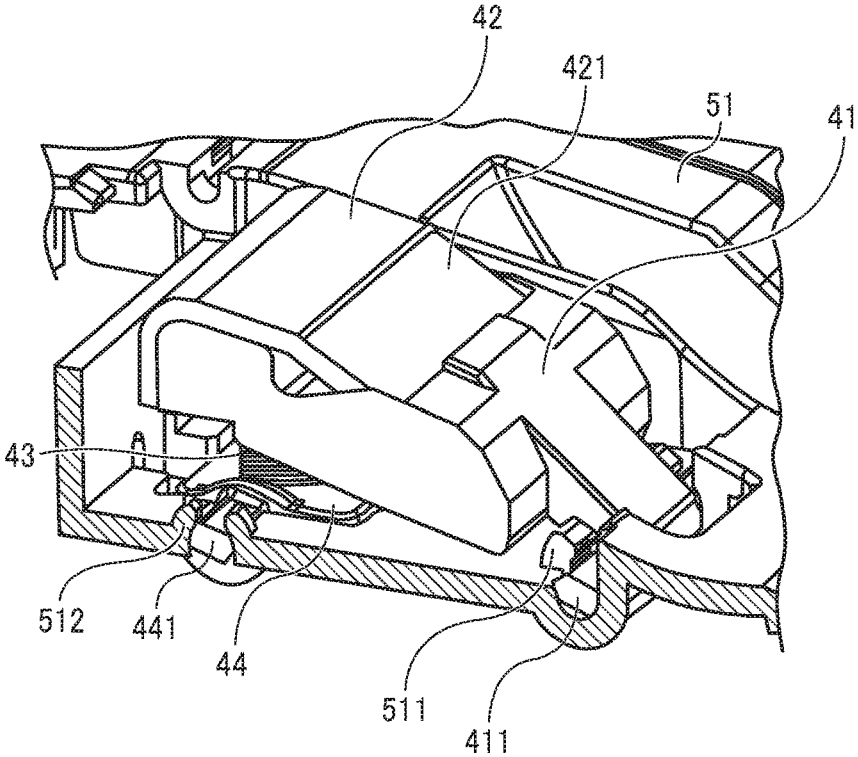
FIG. 8 is an enlarged perspective cross-sectional view of the auto document feeder, illustrating a cross section in immediately front of the separation pad holder.

FIG. 6 is an enlarged perspective view of the vicinity of the separation pad 42 in a state in which the document feeder cover 360 and the unit holding the document feed roller 302 are detached from the auto document feeder 310 of the present embodiment. As illustrated in FIG. 6, the separation pad holder 41 holding the separation pad 42 is disposed at the center in a width direction of a document feeding guide 51, positioned on the downstream side in the conveyance direction of the document MS, with respect to the document placing base 311 in the apparatus body of the auto document feeder 310. FIG. 7 is an enlarged perspective view of the auto document feeder 310 in a state in which the separation pad holder 41 is detached from the state illustrated in FIG. 6. FIG. 8 is an enlarged perspective cross-sectional view of the auto document feeder 310 illustrating a cross section in immediately front (front in a width direction orthogonal to the paper surface of FIG. 4) of the separation pad holder 41 in the auto document feeder 310 in the state illustrated in FIG. 6.

As illustrated in FIGS. 7 and 8, the first rotary shaft 411 and the second rotary shaft 441 are detachably attached to the apparatus body of the auto document feeder 310 by a first shaft holder 511 and a second shaft holder 512, respectively. As illustrated in FIG. 8, cross sections of the first rotary shaft 411 and the second rotary shaft 441 and shaft holes of the first shaft holder 511 and the second shaft holder 512 have oval shapes, and thus, the attachment and detachment operation becomes easy, and replaceability improves.

As illustrated in FIGS. 6 and 8, the separation pad holder 41 includes a guide sheet 421 on the upstream side in the conveyance direction of the separation pad 42 to be configured to smoothly guide the leading end of the document MS to the separation nip between the document feed roller 302 and the separation pad 42. With the guide sheet 421, it is possible to alleviate leading end damage when the document MS to be conveyed is thin paper, and to prevent non-feeding when the document MS to be conveyed is thick paper.

Figure 9:
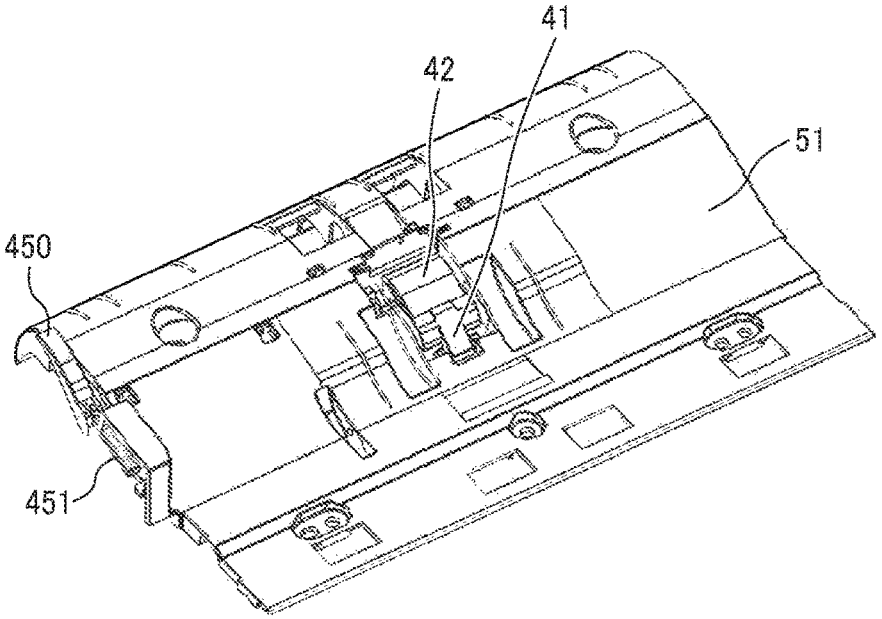
FIG. 9 is a perspective view of a document feeding guide.

Next, a description will be given regarding a configuration in which a position of the separation pad holder 41 is temporarily secured when mounting the separation pad holder 41 and the document feeder cover 360 is closed to form a state in which the separation pad 42 is pressed toward the document feed roller 302. FIG. 9 is a perspective explanatory view of the document feeding guide 51, and a separation pressure release lever 450 and a separation pressure release spring 451 are provided at a front-side end portion in a width direction (direction orthogonal to the paper surface of FIG. 4) of the document feeding guide 51.

Figure 10:
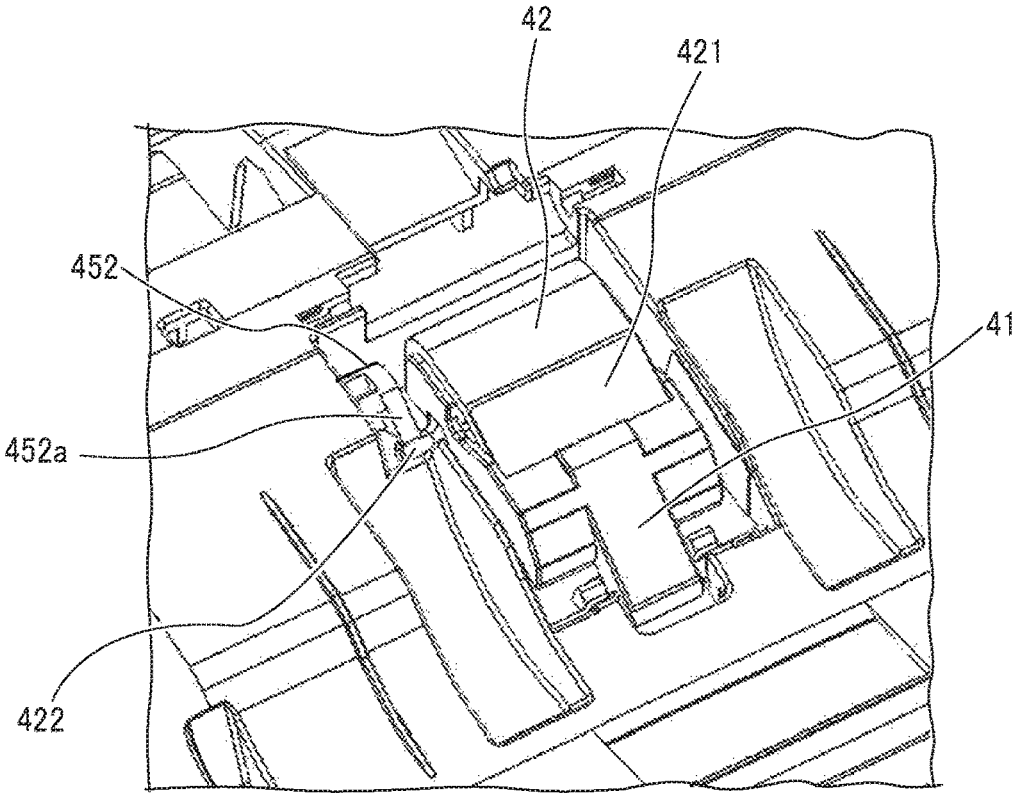
FIG. 10 is an enlarged perspective view of the vicinity of a center in a width direction of the document feeding guide.

FIG. 10 is an enlarged perspective view of the vicinity of the center in the width direction of the document feeding guide 51 illustrated in FIG. 9. As illustrated in FIG. 10, a pad holder protrusion holding portion 452, which rotates in conjunction with rotation of the separation pressure release lever 450, is provided in the document feeding guide 51 on the apparatus body side, and a pad holder protrusion 422 is provided in the separation pad holder 41.

Figure 11:
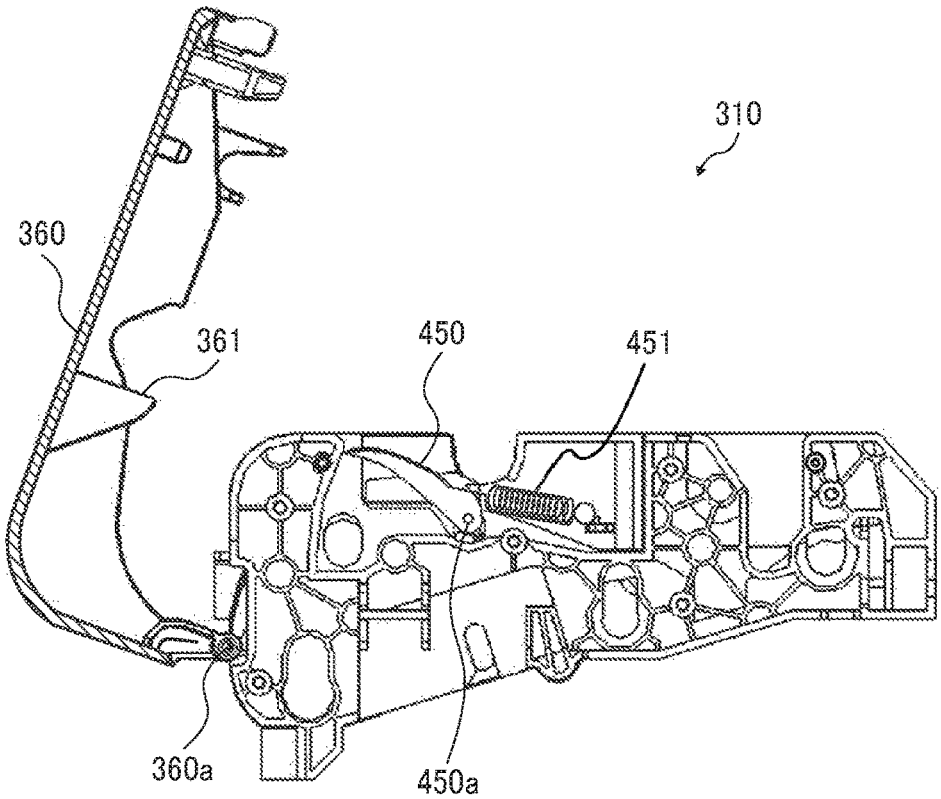
FIG. 11 is a cross-sectional view of a side in immediately front of a separation pressure release lever in the auto document feeder with an opened document feeder cover.

FIG. 11 is a cross-sectional view of a side in immediately front (front in the width direction orthogonal to the page of FIG. 4) of the separation pressure release lever 450 in the auto document feeder 310 of the present embodiment. FIG. 11 illustrates a state in which the document feeder cover 360 is opened.

The separation pressure release lever 450 is rotatable about a pressure release lever rotary shaft 450*a*. The separation pressure release spring 451 pulls the separation pressure release lever 450 in the left direction in FIG. 11 to apply a biasing force to rotate the separation pressure release lever 450 in the clockwise direction in FIG. 11 about the pressure release lever rotary shaft 450*a*. The document feeder cover 360 is opened or closed while rotating about a cover rotary shaft 360*a* with respect to the apparatus body of the auto document feeder 310.

The document feeder cover 360 is brought into the closed state by being rotated in the clockwise direction about the cover rotary shaft 360*a* from the state illustrated in FIG. 11 which is a released state. The document feeder cover 360 has a pressure release lever pressing portion 361 to press the separation pressure release lever 450 from above when the document feeder cover 360 is closed and rotate the separation pressure release lever 450 in the counterclockwise direction in FIG. 11 against a biasing force of the separation pressure release spring 451. The pad holder protrusion holding portion 452 illustrated in FIG. 10 has a claw portion 452*a* to which the pad holder protrusion 422 is caught, and rotates in conjunction with the rotational operation of the separation pressure release lever 450.

First, the first rotary shaft 411 is engaged with the first shaft holder 511 when attaching the separation pad holder 41. Next, the separation pad holder 41 is rotated about the first rotary shaft 411 in the direction opposite to arrow D in FIG. 1. At this time, if the separation pad holder 41 is rotated without operating the separation pressure release lever 450, the pad holder protrusion 422 of the separation pad holder 41 abuts on the claw portion 452*a* of the pad holder protrusion holding portion 452. As a worker manually pushes down the separation pressure release lever 450, the pad holder protrusion holding portion 452 rotates such that the claw portion 452*a* retreats upward from the state illustrated in FIG. 10. As a result, the separation pad holder 41 can be rotated to a mounting position.

Next, as a hand is released from the separation pressure release lever 450, the separation pressure release lever 450 and the pad holder protrusion holding portion 452 rotate by the biasing force of the separation pressure release spring 451, and the claw portion 452*a* is positioned above the pad holder protrusion 422. In this state, when the hand is released from the separation pad holder 41, the separation pad holder 41 tries to rotate in the same direction as the direction of arrow D in FIG. 1 by the biasing force of the separation-pressing spring 43, but the pad holder protrusion 422 abuts on the claw portion 452*a* as illustrated in FIG. 10. Thus, a position of the separation pad holder 41 can be temporarily secured.

Next, the unit holding the document feed roller 302 is mounted, and the document feeder cover 360 is closed. At this time, the pressure release lever pressing portion 361 pushes down the separation pressure release lever 450, and the pad holder protrusion holding portion 452 rotates such that the claw portion 452*a* retreats upward from the state illustrated in FIG. 10. As a result, the pad holder protrusion 422 does not abut on the claw portion 452*a* and the separation pad holder 41 rotates in the same direction as the direction of arrow D in FIG. 1 by the biasing force of the separation-pressing spring 43. With this rotation, the separation pad 42 held by the separation pad holder 41 abuts on the document feed roller 302, and the separation pad 42 is pressed toward the document feed roller 302.

When the document feeder cover 360 is released in this state, the pressure release lever pressing portion 361 is spaced apart from the separation pressure release lever 450, and the separation pressure release lever 450 and the pad holder protrusion holding portion 452 rotate by the biasing force of the separation pressure release spring 451. At this time, the claw portion 452*a* of the pad holder protrusion holding portion 452 pushes down the pad holder protrusion 422, and the separation pad 42 is spaced apart from the document feed roller 302 to form a state in which a separation pressure at the separation nip is released.

Figure 12:
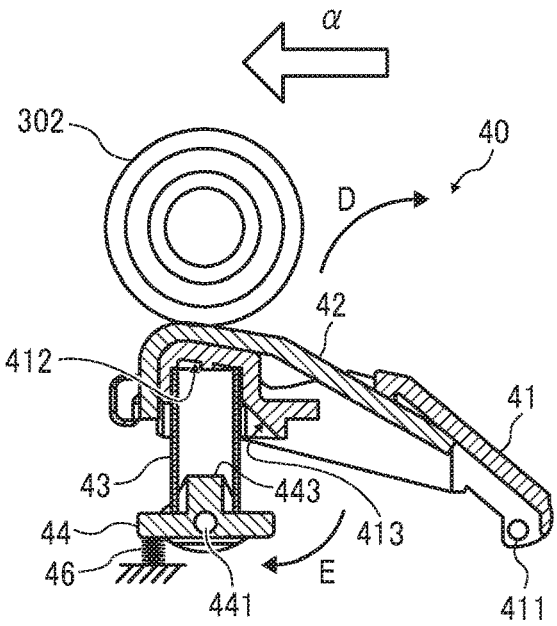
FIG. 12 is an enlarged cross-sectional view of a document separation mechanism in an auto document feeder according to a variation.

Variation Next, a variation of a configuration in which a spring holder 44 rotates such that a separation-pressing spring 43 is inclined will be described. FIG. 12 is an enlarged cross-sectional view of a document separation mechanism 40 in an auto document feeder 310 according to the variation. In the document separation mechanism 40 of the above embodiment, the center of gravity of the spring holder 44 is positioned to be closer to a side of the detachment direction of the separation pad holder 41 than the second rotary shaft 441, and the spring holder 44 is rotated by own weight of the spring holder 44. On the other hand, the document separation mechanism 40 of the variation includes a spring holder rotation spring 46 to apply a biasing force such that the spring holder 44 rotates in a rotation direction in which the separation-pressing spring 43 is inclined in a detachment direction of the separation pad holder 41. The document separation mechanism 40 of the variation illustrated in FIG. 12 has the same configuration as the document separation mechanism 40 of the embodiment described with reference to FIGS. 1 and 5, except that the configuration of rotating the spring holder 44 is different.

When the separation pad holder 41 is rotated from the state illustrated in FIG. 12 in the clockwise direction in FIG. 12 (a direction of arrow D) the separation-pressing spring 43 is spaced apart from the separation pad holder 41. When the separation-pressing spring 43 is spaced apart from the separation pad holder 41, the spring holder 44 rotates in the clockwise direction (a direction of an arrow "E") in FIG. 12 by a biasing force of the spring holder rotation spring 46. At this time, the spring holder 44 stops at a position at which the biasing force of the spring holder rotation spring 46 and a restoring force of the spring holder 44 are in equilibrium. Thus, the separation-pressing spring 43 can be inclined in a moving direction of the separation pad holder 41 when detaching the separation pad holder 41, which is similar to the above embodiment. It is possible to bring a leading end of the separation-pressing spring 43 in contact with the pressing force acting portion 412 of the separation pad holder 41 when attaching the separation pad holder 41. As a result, after attachment, the separation-pressing spring 43 is set to a desired posture illustrated in FIG. 12, and a desired biasing force is applied to the separation pad holder 41. Thus, it is possible to obtain desired separation performance and to prevent occurrence of multiple feeding and non-feeding.

Although the present variation has the configuration in which a compression spring is used as a second biasing member to bias the separation pad holder 41, it is possible to use a member that utilizes elasticity of the member, such as a leaf spring and a resin part, as the biasing member.

The configuration in which the separation conveyor is a roller member and the separation resistance member is a friction pad has been described in the present embodiment. The combination of the separation conveyor and the separation resistance member is not limited to the embodiment. Examples of the configuration include a combination in which the separation conveyor is a belt and the separation resistance member is a friction pad, a combination in which the separation conveyor and the separation resistance member are roller members, a combination in which the separation conveyor is a belt and the separation resistance member is a roller member, a combination in which the separation conveyor and the separation resistance member are belts, and the like. That is, any combination of a member to convey a sheet such as the document MS and a member to hinder movement of the sheet in the conveyance direction may be adopted.

The description has been given in the above embodiment regarding the case in which the sheet conveying device including the separator to convey the plurality of sheets one by one is the auto document feeder (ADF) serving as the document feeder to convey the document. The sheet conveying device including the separator is not limited to the auto document feeder and may be any suitable type of sheet conveying device including a separator. For example, the sheet conveying device including the separator may also be the sheet feeding device 210, which conveys the paper P contained in the sheet containing cassette 26 of FIG. 2 toward the printer 200 and includes the sheet feeding separation mechanism 27 as the separator.

Examples of the sheet conveyed by the sheet conveying device according to the present disclosure include plain paper, cardboard, postcards, envelopes, thin paper, coated paper (coat paper, art paper, and the like), label paper, overhead projector (OHP) sheets, fabric, recording sheets, and films, which means a medium on which a developer or an ink can adhere. Examples of the sheet further include a medium referred to as a recorded medium, a recording medium, recording paper, paper for recording, and the like.

The description has been given in the present embodiment regarding the case in which the image forming apparatus including the sheet conveying device according to an embodiment of the present disclosure is the copier including the electrophotographic image formation unit. The image forming apparatus according to an embodiment of the present disclosure is not limited to the electrophotographic image formation unit, and may be any suitable type of image forming apparatus including a mechanism to convey a sheet such as a facsimile, a printer, a printing machine, and an inkjet type recording device.

The "image forming apparatus" to which an embodiment of the present disclosure can be applied means an apparatus to perform image formation by causing a developer or an ink to adhere to a medium such as paper, OHP sheets, thread, fibers, fabric, leather, metal, plastic, glass, wood, and ceramics. Further, the "image formation" means not only to impart an image having meanings such as letters and figures to the medium but also to impart an image having no meaning such as a pattern to the medium.

The above description is presented merely by way of example. Characteristic effects are offered for each of following aspects.

Aspect A

A sheet conveying device, such as the auto document feeder 310, includes a separator, such as the document separation mechanism 40, to separate a sheet from a plurality of sheets, such as the document MS. The separator includes: a separation conveyor, such as the document feed roller 302, to convey the sheet; a separation resistance member, such as the separation pad 42, to press against the separation conveyor via the sheet; a resistance-member holder, such as the separation pad holder 41, which holds the separation resistance member and is rotatable about a resistance-member rotary shaft, such as the first rotary shaft 411, with respect to an apparatus body; and a biasing member, such as the separation-pressing spring 43, to contact and bias the resistance-member holder to press the separation resistance member toward the separation conveyor. The resistance-member holder is rotated about the resistance-member rotary shaft to cause the resistance-member holder to be spaced apart from the biasing member when the resistance-member holder is detached from the apparatus body. The separator further includes a biasing-member holder, such as the spring holder 44, which holds the biasing member and is rotatable about a biasing-member rotary shaft such as the second rotary shaft 441. The biasing-member holder rotates to more incline the biasing member in a state of being spaced apart from the resistance-member holder, such as the state illustrated in FIG. 1, in a moving direction of the resistance-member holder that moves to detach from the apparatus body than the biasing member in a biasing state, such as the state illustrated in FIG. 5, in which the biasing member biases the resistance-member holder in contact with the resistance-member holder. When the resistance-member holder is detached, a position of a contact portion between the biasing member and the resistance-member holder, such as a leading end portion of the biasing member, (hereinafter referred to as the "contact portion of the biasing member") moves in a biasing direction in the biasing member that has biased the resistance-member holder since the biasing member that has been compressed recovers a natural length or the like. If the contact portion of the biasing member (a leading end of the separation-pressing spring 43 or the like) moves in the biasing direction without inclining the biasing member, a distance between the contact portion of the biasing member and the resistance-member rotary shaft increases as compared to the state before detaching the resistance-member holder. If the resistance-member holder is rotatably moved in an opposite direction to the case of detaching about the resistance-member rotary shaft when attaching the resistance-member holder to the apparatus body in such a state in which the distance has increased, a portion of the resistance-member holder in contact with the biasing member (the contact portion of the resistance-member holder) is formed at a position different from a position before the detachment. Thus, there is a disadvantage that it is difficult to attach the resistance-member holder such that the biasing member comes into contact with the same position as the position before detaching the resistance-member holder. When the position of the contact portion of the resistance-member holder changes before and after the operation of replacing the resistance-member holder, the contact portion of the resistance-member holder is mounted in the state of deviating from a desired contact position. As a result, it is difficult for the biasing member to apply a desired biasing force to the resistance-member holder, and a contact pressure of the separation resistance member with respect to the separation conveyor does not become a desired pressure, either, so that it is difficult to obtain desired separation performance. In the aspect A, the biasing-member holder rotates, and the biasing member is inclined in the moving direction of the resistance-member holder when detaching the resistance-member holder. It is possible to reduce the distance between the contact portion of the biasing member and the resistance-member rotary shaft in the state in which the biasing member is spaced apart from the resistance-member holder by inclining the biasing member as compared with the case of not inclining the biasing member. As the biasing member is inclined such that the distance between the contact portion of the biasing member and the resistance-member rotary shaft becomes the same distance as the distance from the desired contact position in the resistance-member holder to the resistance-member rotary shaft, it is possible to bring the biasing member into contact with the desired contact position of the resistance-member holder. The resistance-member holder is further rotated in the state in which the biasing member is in contact with the desired contact position to complete the attachment to the apparatus body. In the aspect A, when the resistance-member holder holding the separation resistance member is mounted to the apparatus body, it is easy to bring the biasing member into contact with the desired contact position of the resistance-member holder, and it is easy to attach the resistance-member holder.

Aspect B

In the aspect A, a center of gravity of the biasing-member holder, such as the spring holder 44, holding the biasing member, such as the separation-pressing spring 43, is positioned on a downstream side of the biasing-member rotary shaft, such as the second rotary shaft 441, in the moving direction of the resistance-member holder, such as the separation pad holder 41, which moves to detach from the apparatus body. According to the aspect B, the biasing-member holder is rotated such that the biasing member is inclined in the moving direction of the resistance-member holder at the time of detaching the resistance-member holder due to its own weight of the biasing-member holder when the biasing member is spaced apart from the resistance-member holder as described in the above embodiment. Thus, it is possible to implement the configuration in which the biasing-member holder rotates in accordance with the rotation operation at the time of attaching and detaching the resistance-member holder, such as the separation pad holder 41, without providing a complex rotation mechanism.

Aspect C

The aspect A or B further includes a second biasing-member, such as a spring holder rotation spring 46, to bias the biasing-member holder such as the spring holder 44 in the rotation direction of the biasing member, such as the separation-pressing spring 43, that is inclined in the moving direction of the resistance-member holder, such as the separation pad holder 41, that moves to detach from the apparatus body. According to the aspect C, the biasing-member holder is rotated such that the biasing member is inclined in the moving direction of the resistance-member holder at the time of detaching the resistance-member holder due to a biasing force of the second biasing member when the biasing member is spaced apart from the resistance-member holder as described in the above variation. Thus, it is possible to implement the configuration in which the biasing-member holder rotates in accordance with the rotation operation at the time of attaching and detaching the resistance-member holder, such as the separation pad holder 41.

Aspect D

In any of the aspects A to C, the biasing-member rotary shaft, such as the second rotary shaft 441, is positioned on a virtual straight line parallel to the biasing direction of the biasing member at an attachment position of the biasing member, such as the separation-pressing spring 43, in the biasing-member holder such as the spring holder 44. According to the aspect D, it is easy to match the position of the contact portion of the biasing member such as the leading end of the separation-pressing spring 43 and the desired contact position (pressing force acting portion 412 or the like) in the resistance-member holder such as the separation pad holder 41 as described in the above embodiment. Thus, it is possible to apply a desired biasing force to the resistance-member holder and to obtain desired separation performance.

Aspect E

A sheet conveying device, such as the auto document feeder 310, includes a separator, such as the document separation mechanism 40, to separate a sheet from a plurality of sheets, such as the document MS. The separator includes: a separation conveyor, such as the document feed roller 302, to convey the sheet; a separation resistance member, such as the separation pad 42, to press against the separation conveyor via the sheet; a resistance-member holder, such as the separation pad holder 41, which holds the separation resistance member and is rotatable about a resistance-member rotary shaft, such as the first rotary shaft 411, with respect to an apparatus body; a biasing member, such as the separation-pressing spring 43, to bias the resistance-member holder to press the separation resistance member toward the separation conveyor; and a biasing-member holder, such as the spring holder 44, which holds the biasing member and is rotatable about a biasing-member rotary shaft, such as the second rotary shaft 441, with respect to the apparatus body. The biasing-member rotary shaft is positioned on a virtual straight line parallel to a biasing direction of the biasing member at an attachment position of the biasing member, such as the separation-pressing spring 43, in the biasing-member holder such as the spring holder 44. According to the aspect D, it is easy to match the position of the contact portion of the biasing member such as the leading end of the separation-pressing spring 43 and the desired contact position (pressing force acting portion 412 or the like) in the resistance-member holder as described in the above embodiment. Thus, it is easy to attach the resistance-member holder such that the biasing member comes into contact with the same position as the position before detaching the resistance-member holder.

Aspect F

A sheet conveying device, such as the auto document feeder 310, includes a separator, such as the document separation mechanism 40, to separate a sheet from a plurality of sheets, such as the document MS. The separator includes: a separation conveyor, such as the document feed roller 302, to convey the sheet; a separation resistance member, such as the separation pad 42, to press against the separation conveyor via the sheet; a resistance-member holder, such as the separation pad holder 41, which holds the separation resistance member and is rotatable about a resistance-member rotary shaft, such as the first rotary shaft 411, with respect to an apparatus body; and a biasing member, such as the separation-pressing spring 43, to bias the resistance-member holder to press the separation resistance member toward the separation conveyor. The separator further includes a biasing-member holder, such as the spring holder 44, which holds the biasing member and is rotatable about a biasing-member rotary shaft, such as the second rotary shaft 441, with respect to the apparatus body. When a rotation position of the biasing-member holder in a state in which the resistance-member holder is detached from the apparatus body is a first rotation position (the state illustrated in FIG. 1 or the like) and a rotation position of the biasing-member holder in a state in which the resistance-member holder is assembled to the apparatus body is a second rotation position (the state illustrated in FIG. 5 or the like), the biasing member held by the biasing-member holder at the first rotation position is positioned at a more downstream side (right side in FIGS. 1 and 5) in a moving direction of the resistance-member holder that moves to detach the apparatus body than the biasing member held by the biasing-member holder at the second rotation position. According to the aspect F, it is easy to bring the biasing member into contact with the desired contact position (pressing force acting portion 412 or the like) in the resistance-member holder as described in the above embodiment. Thus, it is easy to attach the resistance-member holder such that the biasing member comes into contact with the same position as the position before detaching the resistance-member holder.

Aspect G

In any one of the aspects A to F, when removing the resistance-member holder, such as the separation pad holder 41, from the apparatus body, the separation conveyor, such as the document feed roller 302, is moved out of a rotation range of the resistance-member holder, and the resistance-member holder is rotated in a rotation direction along the biasing direction of the biasing member, such as the separation-pressing spring 43, to be rotated up to a predetermined rotation position at which a biasing force of the biasing member does not act so as to enable detachment of the resistance-member holder from the apparatus body. According to the aspect G, it is easy to bring the biasing member into contact with the desired contact position of the resistance-member holder, and it is easy to attach the resistance-member holder with the configuration in which the resistance-member holder is rotated to be detached from the apparatus body as described in the above embodiment.

Aspect H

In any one of the aspects A to G, the biasing-member holder rotates along with an attachment and detachment operation of the resistance-member holder, such as the separation pad holder 41, with respect to the apparatus body. According to the aspect H, it is possible to attach the resistance-member holder to the apparatus body and it is easy to attach the resistance-member holder in a state in which the biasing member, such as the separation-pressing spring 43, is in a desired posture merely with the operation of mounting the resistance-member holder as described in the above embodiment.

Aspect I

In any one of the aspects A to H, the sheet conveying device has a guiding shape, such as a guide-shaped portion 413, to guide the biasing member, such as the separation-pressing spring 43, contacting the resistance-member holder to a contact position (pressing force acting portion 412 or the like) set in the resistance-member holder when the resistance-member holder, such as the separation pad holder 41, is assembled to the apparatus body. According to the aspect I, it is easy to bring the biasing member into contact with the desired contact position of the resistance-member holder, and it is easy to attach the resistance-member holder as described in the above embodiment.

Aspect J

In any one of the aspects A to I, the biasing member, such as the separation-pressing spring 43, includes a rotation regulator, such as the rotation regulator 45, to regulate a rotation range of the biasing-member holder, such as the spring holder 44, in a direction to be inclined toward the moving direction of the resistance-member holder, such as the separation pad holder 41, which moves to detach from the apparatus body. According to the aspect J, it is possible to cause the biasing member to be brought into contact and engaged with the desired contact position (pressing force acting portion 412 or the like) in the resistance-member holder as described in the above embodiment. As a result, it is possible to attach the resistance-member holder to the apparatus body in the state in which the biasing member is in the desired posture.

Aspect K

In any one of the aspects A to J, the sheet container, such as a document placing base 311, to contain a plurality of sheets, such as the document MS and a sheet feeder, such as the pickup roller 301, to feed the sheet from the plurality of sheets contained in the sheet containers toward the separator such as the document separation mechanism 40 are provided. According to the aspect K, it is possible to implement the configuration in which it is easy to attach the resistance-member holder with the configuration of conveying the sheet contained in the sheet container as described in the above embodiment.

Aspect L

An image reading device, such as the image reading device 300, includes: a sheet conveyor to convey a sheet such as the document MS; and an image reader, such as the scanner 320, to read an image on a surface of the sheet conveyed by the sheet conveyor. The sheet conveying device, such as the auto document feeder 310, according to any one of the aspects A to K is provided as the sheet conveyor. According to the aspect L, it is easy to attach the resistance-member holder, and thus, it is possible to improve the maintainability of the image reading device as described in the above embodiment.

Aspect M

An image forming apparatus, such as the copier 100, includes: an image reader; and an image formation unit, such as the printer 200, to form an image based on a read image read by the image reader. The image reading device, such as the image reading device 300 according to the aspect L, is provided as the image reader. According to the aspect M, it is possible to obtain stable separation performance with the sheet conveyor and to perform stable image reading with the image reading device due to improved maintainability, and it is possible to perform stable copying as described in the above embodiment.

Aspect N

An image forming apparatus, such as the copier 100, includes: a sheet conveyor to convey a sheet such as the paper P; and an image formation unit, such as the printer 200, to form an image on the sheet conveyed by the sheet conveyor. The sheet conveying device, such as the sheet feeding device 210, according to any one of the aspects A to K is provided as the sheet conveyor. According to the aspect N, it is easy to attach the resistance-member holder, and it is possible to obtain the stable separation performance with the sheet conveyor due to the improved maintainability of the sheet conveying device, and thus, it is possible to perform stable image formation as described in the above embodiment.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet conveying device comprising a separator to separate a sheet from a plurality of sheets, the separator including:

a separation conveyor to convey the sheet;

a separation resistance member to press against the separation conveyor via the sheet;

a resistance-member rotary shaft;

a resistance-member holder, rotatable about the resistance-member rotary shaft with respect to an apparatus body, to hold the separation resistance member;

a biasing member to contact and bias the resistance-member holder to press the separation resistance member toward the separation conveyor, the resistance-member holder configured to rotate about the resistance-member rotary shaft to separate from the biasing member in detaching from the apparatus body;

a biasing-member rotary shaft; and a biasing-member holder, rotatable about the biasing-member rotary shaft, to hold the biasing member, the biasing-member holder configured to rotate to more incline the biasing member in a state, in which the biasing member is spaced apart from the resistance-member holder, in a moving direction of the resistance-member holder that moves to detach from the apparatus body than the biasing member in a biasing state in which the biasing member biases the resistance-member holder in contact with the resistance-member holder.

2. The sheet conveying device according to claim 1, wherein a center of gravity of the biasing-member holder holding the biasing member is positioned on a downstream side of the biasing-member rotary shaft in the moving direction of the resistance-member holder that moves to detach from the apparatus body.

3. The sheet conveying device according to claim 1, further comprising a second biasing member to bias the biasing-member holder in a rotation direction of the biasing member that is inclined in the moving direction of the resistance-member holder that moves to detach from the apparatus body.

4. The sheet conveying device according to claim 1, wherein the biasing-member rotary shaft is positioned on a virtual straight line parallel to a biasing direction of the biasing member at an attachment position of the biasing member in the biasing-member holder.

5. The sheet conveying device according to claim 1, wherein the resistance-member holder is detachable from the apparatus body by moving the separation conveyor out of a rotation range of the resistance-member holder and rotating the resistance-member holder in a rotation direction along a biasing direction of the biasing member, up to a predetermined rotation position at which a biasing force of the biasing member does not act on the resistance-member holder.

6. The sheet conveying device according to claim 1, wherein the biasing-member holder rotates along with an attachment or detachment operation of the resistance-member holder with respect to the apparatus body.

7. The sheet conveying device according to claim 1, wherein the sheet conveying device has a guiding shape to guide the biasing member contacting the resistance-member holder to a contact position set in the resistance-member holder when the resistance-member holder is assembled to the apparatus body.

8. The sheet conveying device according to claim 1, wherein the biasing member includes a rotation regulator to regulate a rotation range of the biasing-member holder in a direction to be inclined toward the moving direction of the resistance-member holder that moves to detach from the apparatus body.

9. The sheet conveying device according to claim 1, further comprising:

a sheet container to contain the plurality of sheets; and a sheet feeder to feed the sheet from the plurality of sheets contained in the sheet container toward the separator.

10. An image reading device comprising:

the sheet conveying device according to claim 1 to convey a sheet; and an image reader to read an image on a surface of the sheet conveyed by the sheet conveying device.

11. An image forming apparatus comprising:

the image reading device according to claim 10; and an image formation unit to form an image based on a read image read by the image reading device.

12. An image forming apparatus comprising:

the sheet conveying device according to claim 1 to convey a sheet; and an image formation unit to form an image on the sheet conveyed by the sheet conveying device.

13. A sheet conveying device comprising a separator to separate a sheet from a plurality of sheets, the separator including:

a separation conveyor to convey the sheet;

a separation resistance member to press against the separation conveyor via the sheet;

a resistance-member holder, rotatable about a resistance-member rotary shaft with respect to an apparatus body, to hold the separation resistance member;

a biasing member to bias the resistance-member holder to press the separation resistance member toward the separation conveyor;

a biasing-member rotary shaft; and a biasing-member holder, rotatable about the biasing-member rotary shaft with respect to the apparatus body, to hold the biasing member, the biasing-member rotary shaft positioned on a virtual straight line parallel to a biasing direction of the biasing member at an attachment position of the biasing member in the biasing-member holder.

14. An image reading device comprising:

the sheet conveying device according to claim 13 to convey a sheet; and an image reader to read an image on a surface of the sheet conveyed by the sheet conveying device.

15. An image forming apparatus comprising:

the image reading device according to claim 14; and an image formation unit to form an image based on a read image read by the image reading device.

16. An image forming apparatus comprising:

the sheet conveying device according to claim 13 to convey a sheet; and an image formation unit to form an image on the sheet conveyed by the sheet conveying device.

17. A sheet conveying device comprising a separator to separate a sheet from a plurality of sheets, the separator including:

a separation conveyor to convey the sheet;

a separation resistance member to press against the separation conveyor via the sheet;

a resistance-member rotary shaft;

a resistance-member holder, rotatable about the resistance-member rotary shaft with respect to an apparatus body, to hold the separation resistance member;

a biasing member to bias the resistance-member holder to press the separation resistance member toward the separation conveyor;

a biasing-member rotary shaft; and a biasing-member holder, rotatable about the biasing-member rotary shaft with respect to the apparatus body, to hold the biasing member, wherein, when a rotation position of the biasing-member holder in a state in which the resistance-member holder is detached from the apparatus body is a first rotation position and a rotation position of the biasing-member holder in a state in which the resistance-member holder is assembled to the apparatus body is a second rotation position, the biasing member held by the biasing-member holder at the first rotation position is positioned at a more downstream side in a moving direction of the resistance-member holder that moves to detach from the apparatus body than the biasing member held by the biasing-member holder at the second rotation position.

18. An image reading device comprising:

the sheet conveying device according to claim 17 to convey a sheet; and an image reader to read an image on a surface of the sheet conveyed by the sheet conveying device.

19. An image forming apparatus comprising:

the image reading device according to claim 18; and an image formation unit to form an image based on a read image read by the image reading device.

20. An image forming apparatus comprising:

the sheet conveying device according to claim 17 to convey a sheet; and an image formation unit to form an image on the sheet conveyed by the sheet conveying device.

* * * * *